US006382907B1

(12) United States Patent
Bregman et al.

(10) Patent No.: US 6,382,907 B1
(45) Date of Patent: May 7, 2002

(54) COMPONENT FOR A GAS TURBINE

(75) Inventors: Vitaly Bregman; Vladimir Filippov, both of Moscow (RU); Sergey Shukin, Finspång (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/700,754

(22) PCT Filed: May 18, 1999

(86) PCT No.: PCT/SE99/00846

§ 371 Date: Jan. 8, 2001

§ 102(e) Date: Jan. 8, 2001

(87) PCT Pub. No.: WO99/61756

PCT Pub. Date: Dec. 2, 1999

(30) Foreign Application Priority Data

May 25, 1998 (SE) ..... 9801825

(51) Int. Cl.[7] ..... F04D 29/58; F01D 5/18

(52) U.S. Cl. ..... 415/115; 416/97 R

(58) Field of Search ..... 415/115, 116; 416/96 R, 97 R, 96 A, 97 A, 92

(56) References Cited

U.S. PATENT DOCUMENTS

| | | | | |
|---|---|---|---|---|
| 3,806,274 A | | 4/1974 | Moore | 416/97 R |
| 3,854,842 A | | 12/1974 | Caudill | 415/116 |
| 4,193,738 A | | 3/1980 | Landis, Jr. et al. | 415/115 |
| 5,052,889 A | | 10/1991 | Abdel-Messeh | 416/97 R |
| 5,738,493 A | * | 4/1998 | Lee et al. | 415/115 |
| 5,779,447 A | * | 7/1998 | Tomita et al. | 416/97 R |
| 5,919,031 A | * | 7/1999 | Hall et al. | 415/115 |

FOREIGN PATENT DOCUMENTS

| | | | |
|---|---|---|---|
| GB | 1410014 | * 10/1975 | 416/96 R |
| RU | 2042833 | 8/1995 | |
| SU | 1228559 | 11/1981 | |

* cited by examiner

*Primary Examiner*—Christopher Verdier
*Assistant Examiner*—Richard Woo
(74) *Attorney, Agent, or Firm*—Connolly Bove Lodge & Hutz LLP

(57) ABSTRACT

The invention refers to a component defining a blade or a vane for a rotary machine having a rotor rotatable about an axis. The component includes an inner space forming a passage for a cooling fluid between first and second walls. First ribs project from the fist wall and extend essentially in parallel to each other to form fist channels for the fluid from a leading part of the inner space to a trailing part of the space. The first ribs extend in a first direction forming a first angle of inclination to the axis in the leading part and in a second direction forming a second angle of inclination to the axis in the trailing part. The first angle is greater than the second angle.

20 Claims, 4 Drawing Sheets

Fig 1
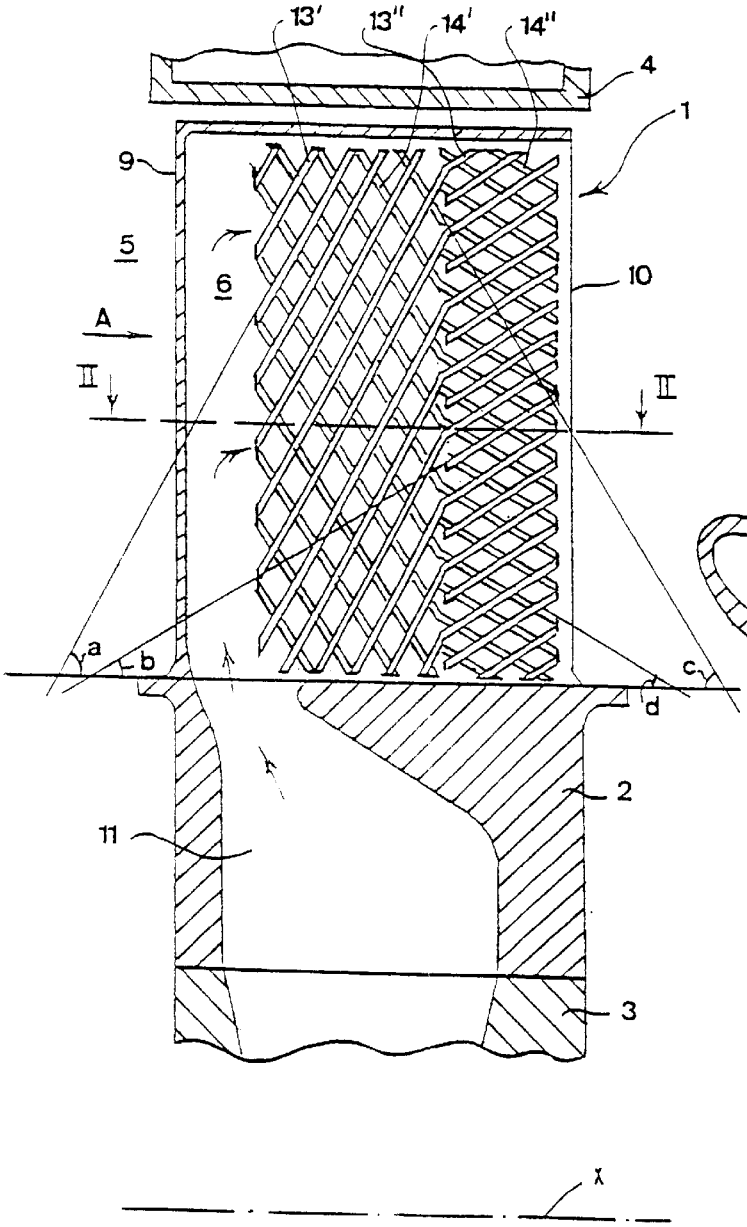
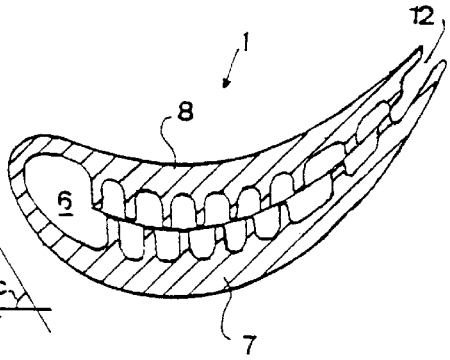
Fig 2

Fig 3
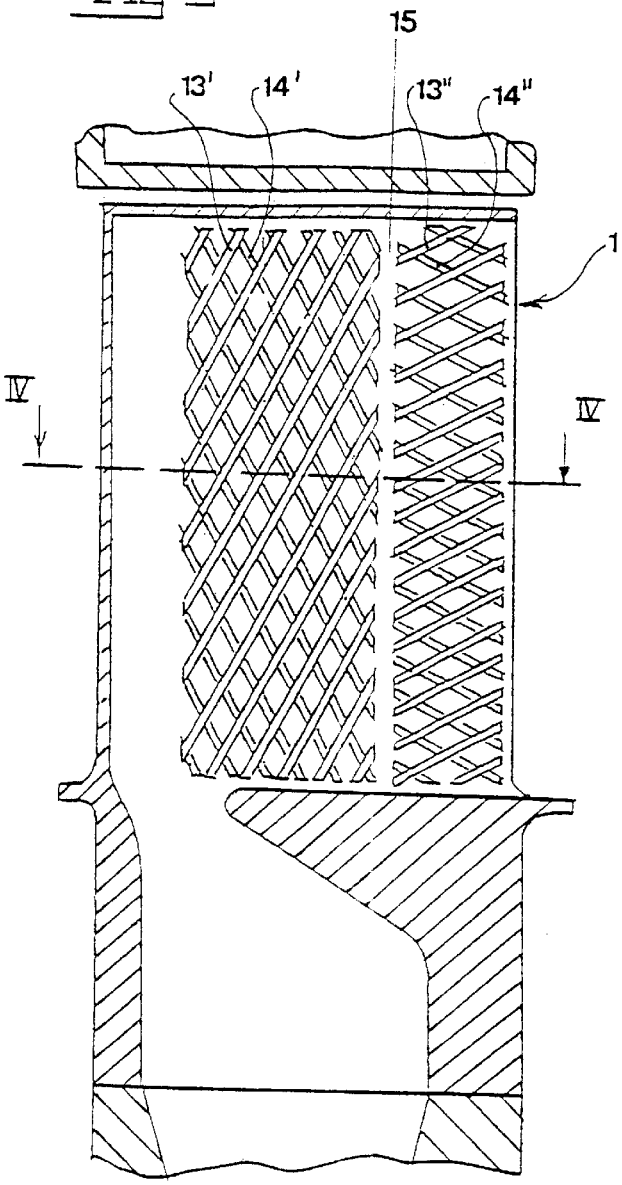
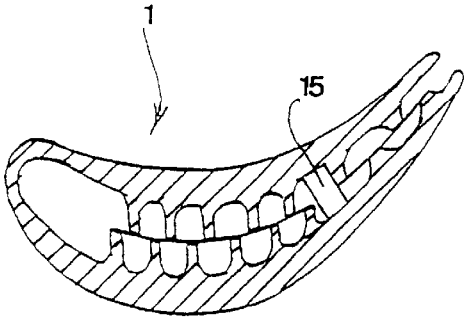
Fig 4

Fig 5
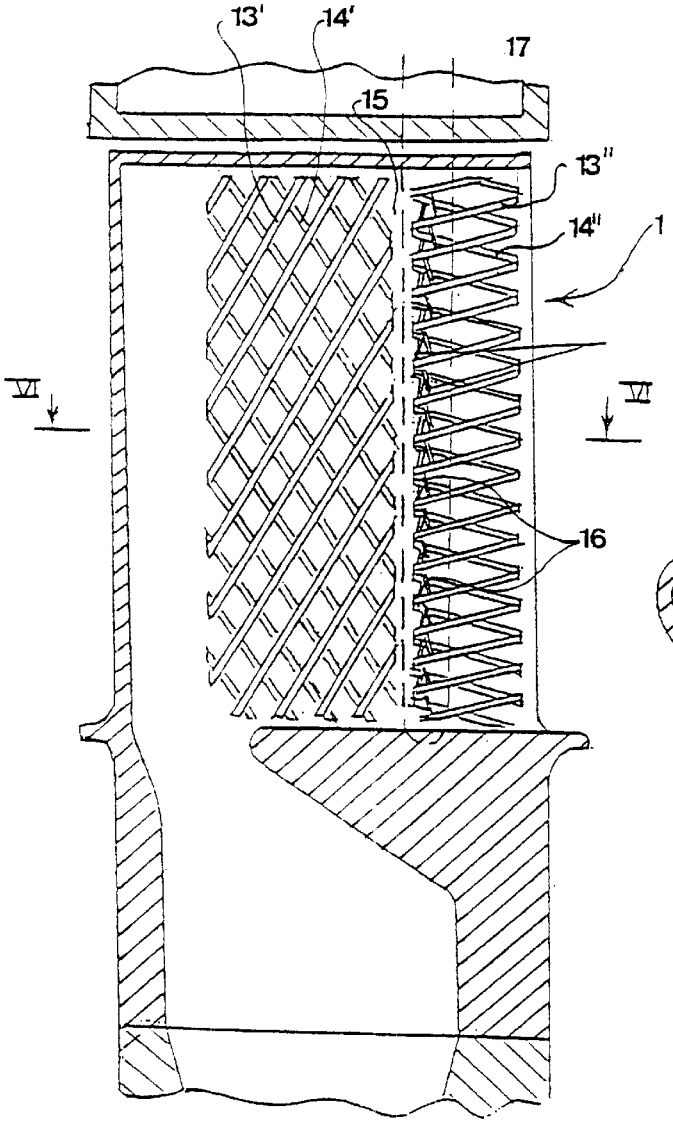
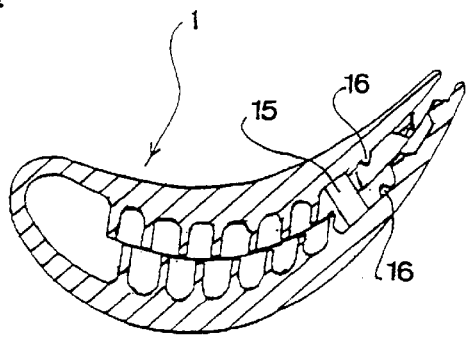
Fig 6

Fig 7
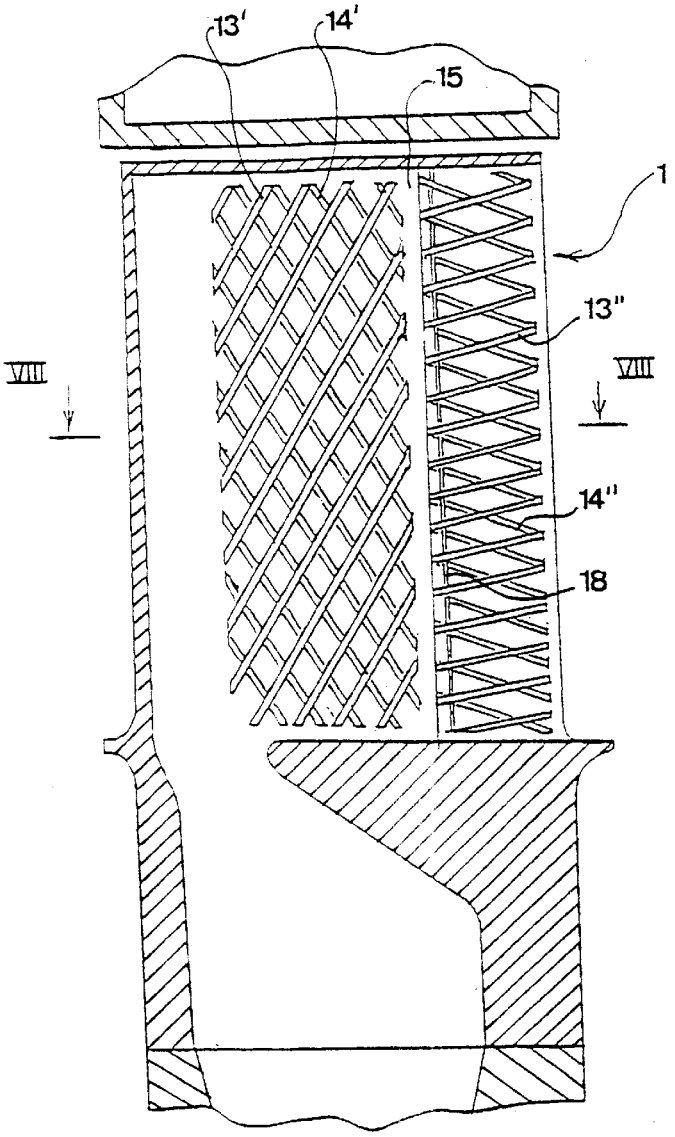
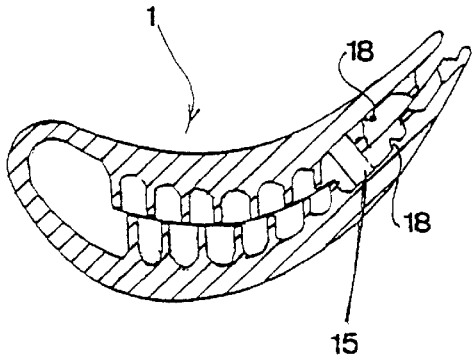
Fig 8

COMPONENT FOR A GAS TURBINE

BACKGROUND OF THE INVENTION AND PRIOR ART

The present invention refers to a component defining one of a blade and a vane for a rotary machine having a rotor which is rotatable about an axis, said component comprising an inner space, forming a passage for a cooling fluid and limited by first and second walls facing each other, and at least first ribs, projecting form said first wall and extending essentially in parallel to each other to form first channels for said fluid from a leading inlet part of the inner space to a trailing outlet part of the inner space.

Although, the present invention is applicable to rotor blades as well as stator guide vanes, it is merely referred to blades in the following description for the sake of simplicity. It is known to provide rotor blades for a gas turbine with such an inner space or cavity connected to a source of a cooling fluid and forming a passage for said fluid. Such gas turbine blades are disclosed in U.S. Pat. No. 3,854,842 and U.S. Pat. No. 4,193,738.

However, such cooling passages of known blades may only provide rather low cooling air velocities due to the limited air mass flow and the difficulty to produce a cavity having a small thickness. Because of the low cooling air velocity only a reduced cooling effect is possible.

In order to improve the cooling effect, GB-A-1 410 014 proposes the provision of a first set of ribs extending in parallel to each other on a first wall of the inner space of the blade and a second set of ribs extending in parallel to each other on a second opposing wall of the inner space of the blade. The ribs are inclined with respect to the rotational axis of the rotor and arranged in such a manner that the first set of ribs crosses the second set of ribs. By such a solution, it is possible to significantly reduce the flow area of the cooling passages without decreasing the thickness of the inner cavity of the blade.

However, this known solution has a substantial deficiency. In a normal rotor blade, the flow area of the cooling passages in the inlet area, i.e. the leading or middle part of the blade, are significantly greater the flow area of the cooling passages in the outlet area, i.e. in the trailing part of the blade, since the thickness of the inner cavity is greater in the central part of the blade or vane than in the trailing end forming the outlet of the cooling passages. This means that the cooling air velocity is lower in the leading and middle parts of the blade than in the trailing part of the blade, i.e. the cooling effect in the leading and middle parts is insufficient.

SUMMARY OF THE INVENTION

The object of the present invention is to overcome the above mentioned deficiency and to improve the cooling effect of a rotor blade or a stator guide vane of a gas turbine or any similar rotary machine.

This object is obtained by the component initially defined and characterized in that said first ribs extend in a first direction forming a first angle of inclination to said axis in said leading part and in a second direction forming a second angle of inclination to said axis in said trailing part, and that the first angle is greater than the second angle. By increasing the inclination of the ribs, and thus the cooling fluid channels in the leading area of the channels, the flow area of the channels is significantly reduced, i.e. the velocity and the heat transfer is raised and thus a more effective cooling of the blade or vane is obtained. Such an improved cooling efficiency, which in accordance with the present invention is achieved by a relatively simple measure, increases the lifetime and the reliability of the blade or vane. Furthermore, it is to be noted that a great angle of inclination of the ribs in the leading and middle part of a rotor blade or stator guide vane, increases the stiffness and thus the strength and reliability of the blade or vane.

According to an embodiment of the invention, second ribs project form said second wall and extend essentially in parallel to each other to form second channels for said fluid from said leading inlet part to said trailing outlet part, wherein said second ribs extend in a third direction forming a third angle of inclination to said axis in said leading part and in a fourth direction forming a fourth angle of inclination to said axis in said trailing part, and that the third angle is greater than the fourth angle. By such a channel arrangement, the cooling fluid may be uniformly distributed in the blade or vane, thereby ensuring sufficient cooling of all parts of the blade or vane. Thereby, the directions of the first ribs may intersect with the directions of the second ribs, i.e. for instance the first ribs will slope upwardly from the leading part whereas the second ribs then will slope downwardly from the leading part. By such an arrangement, the second ribs will promote turbulences in the first channels and the first ribs will promote turbulences in the second channels.

According to a further embodiment of the invention, the first ribs are joined to the second ribs in said point of intersection. In such manner, the strength of the blade or vane is significantly improved in comparison with a continuous inner cavity.

According to a further embodiment of the invention, the absolute values of said first and third angles are essentially equal at least in a point of intersection. Moreover, the absolute values of said second and fourth angles may also be essentially equal at least in a point of intersection.

According to a further embodiment of the invention, the first ribs are provided on a suction side of the component and sloping upwardly from said axis and from the inlet part of the channels, and the second ribs are provided on a pressure side of the component and sloping downwardly to said axis and from the inlet part of the channels. By such an arrangement, the air flow heat transfer intensification will be greater on the pressure side of a rotor blade, which increases the cooling effect of the pressure side having a higher temperature than the suction side of the rotor blade.

According to a further embodiment of the invention, said ribs are divided into a leading set of ribs and a trailing set of ribs by means of a gap. By such a gap, a more uniform distribution of the cooling flow may be obtained. Thereby, a projecting element may be provided in at least one of said channels and arranged to increase the turbulence of the cooling fluid, and thus to improve the cooling efficiency. Furthermore, said projecting element may be provided at the inlet zone of at least one of the leading and trailing sets of ribs. The projecting element may be shaped as a rib element, which may project form one of said first and second walls and extend in a direction parallel to an inlet edge line of the actual set of ribs.

According to a further embodiment of the invention, the first angle of inclination is between 40 and 80°, preferably between 60 and 80°, and the second angle of inclination is between 10 and 50°.

BRIEF DESCRIPTION OF THE DRAWINGS

The present invention is now to be explained in connection with different embodiments, merely described by way of examples, and with reference to the drawings attached.

FIG. 1 shows a longitudinal sectional view of a blade according a first embodiment of the invention.

FIG. 2 shows a cross sectional view along the line II—II of the blade in FIG. 1.

FIG. 3 shows a longitudinal sectional view of a blade according a second embodiment of the invention.

FIG. 4 shows a cross sectional view along the line IV—IV of the blade in FIG. 3.

FIG. 5 shows a longitudinal sectional view of a blade according a third embodiment of the invention.

FIG. 6 shows a cross sectional view along the line VI—VI of the blade in FIG. 5.

FIG. 7 shows a longitudinal sectional view of a blade according a fourth embodiment of the invention.

FIG. 8 shows a cross sectional view along the line VIII—VIII of the blade in FIG. 7.

DETAILED DESCRIPTION OF DIFFERENT EMBODIMENTS

FIGS. 1 and 2 discloses a rotor blade 1 with a root portion 2 which is connected to a rotor shaft 3 of a gas turbine. The rotor shaft 3 is rotatable about a rotational axis x. The rotor shaft 3 and the rotor blades 1 form a rotor enclosed within a casing 4. The casing 4 and the rotor defines a flow channel 5 in which a gas flows in the direction of the arrow A.

The rotor blade 1 comprises an inner space or cavity 6 forming a passage for a cooling fluid and limited by a first wall 7 and a second wall 8 facing the first wall 7. The first wall 7 forms the suction side of the rotor blade 1 and the second wall 8 forms the pressure side of the rotor blade 1. The rotor blade 1 has a leading end or part 9 and a trailing and/or part, which indicate the direction of the flow along the surfaces of the rotor blade 1. The inner space 6 is connected to an inlet channel 11 which enters into the leading part 9 of the rotor blade 1 and extend through the root portion 2 from a source of cooling pressure air, for instance from the compressor (not disclosed) of the gas turbine. Moreover, the inner space 6 is connected to an outlet 12 formed in the trailing part 10 of the rotor blade 1 between the first and second walls 8. The outlet 12 extend along the whole length of the rotor blade 1.

In accordance with the present invention, the inner space 6 comprises first ribs provided on the first wall 7 and second ribs provided on the second wall 8. The first ribs comprise a leading set of ribs 13' and a trailing set of ribs 13". The leading set of ribs 13' extends essentially in parallel to each other and so do the trailing set of ribs 13". Also the second ribs comprises a leading set of ribs 14' and a trailing set of ribs 14", and the leading set of ribs 14 extend essentially in parallel to each other as well as the trailing set of ribs 14". It is to be noted, that the leading sets of ribs 13', 14' extend in the leading part 9 and a middle part of the blade 1 between the leading part 9 and the trailing part 10, although it is referred to the leading part 9 of the blade 1 in the following for the sake of simplicity.

The leading set of ribs 13' extends in a first direction forming a first angle a of inclination to the rotational axis x and the trailing set of ribs 13" extends in a second direction forming a second angle b of inclination to the rotational axis x. As appears from FIG. 1, the first angle a is greater than the second angle b. In the same way, the leading set of ribs 14' extends in a third direction forming a third angle c of inclination to the rotational axis x and the trailing set of ribs 13" extends in a fourth direction forming a fourth angle d of inclination to the rotational axis x, wherein the third angle c is greater than the fourth angle d. It is to be noted that the absolute values of the first angle a and the third angle c are essentially equal and that the absolute values of the second angle b and fourth angle d are essentially equal. By the rib arrangement disclosed the first ribs 13', 13" form flow channels extending a first direction and crossing corresponding channels formed by the second ribs 14', 14". The first and second directions intersect with each other in such a manner that the ribs 13', 13" and 14', 14" cross each other and are joined together in the point of intersection.

As appears from FIG. 1 twice as many first and second ribs 13', 13", 14', 14" may be provided in the trailing part 10 than in the leading part 9, in such a manner that each flow channel of the leading part 9 is divided into two flow channels in the trailing part 10. By the arrangement disclosed it is thus possible to obtain an essentially uniform flow velocity in the thicker leading part 9, the central middle part of the blade 1 as well as in the thinner trailing part 10.

FIGS. 3 and 4 disclose a second embodiment of the invention, in which the leading set of ribs 13', 14' are separated from the trailing set of ribs 13", 14" by a gap 15. By such a gap 15, it is possible to distribute the cooling fluid from the flow channels of the leading part 9 uniformly into the flow channels of the trailing part 10.

FIGS. 5 and 6 disclose a third embodiment of the invention, in which projecting ribs 16 are provided in the inlet zone 17 of each flow channel of the trailing part 10. By such projecting ribs 16, the turbulences in the flow channels of trailing part 10 may be increased, thereby improving the cooling effect obtained. The ribs 16 extend in a direction essentially perpendicular to the third and fourth directions, respectively.

FIGS. 7 and 8 disclose a fourth embodiment, in which projecting ribs 18 are provided to extend in a direction essentially parallel to an inlet edge line 19 of the flow channels of the trailing part 10.

It is to be noted that such projecting ribs 16, 18 or any similar projecting elements also may be provided as an alternative or a complement in the flow channels of the leading part 9. Furthermore, projecting elements may not only be provided in the inlet zone of the flow channels but anywhere in these channels.

The present invention is not limited to the embodiments disclosed but may be varied and modified within the scope of the following claims.

For instance, the ribs 13', 13" and 14', 14", respectively, may extend along a continuous path comprising a curve at which the angle of inclination is changed from the first angle a and third angle c, respectively, to the second angle b and fourth angle d, respectively.

In case that the component is applied to a stator vane, the first ribs may be provided on the suction side of the component and sloping downwardly to said axis and from the leading part of said channels, and the second ribs may be provided on a pressure side of the component and sloping upwardly from said axis from the heading part of said channels.

What is claimed is:

1. A component defining one of a blade and a vane for a rotary machine having a rotor (3) which is rotatable about an axis (x), said component (1) comprising an inner space (6), forming a passage for a cooling fluid and limited by first and second walls (7, 8) facing each other, and at least first ribs (13', 13"), projecting from said first wall (6) and extending essentially in parallel to each other to form first channels for said fluid from a leading inlet part (9) of the channels to a trailing outlet part (10) of the channels, characterized in that said first ribs (13',13") extend in a first direction forming a first angle (a) of inclination to said axis (x) in said leading part (9) and in a second direction forming a second angle (b) of inclination to said axis (x) in said trailing part (10), and that the first angle (a) is greater than the second angle (b).

2. A component according to claim 1, characterized by second ribs (14', 14") projecting from said second wall (8) and extending essentially in parallel to each other to form second channels for said fluid from said leading inlet part (9) to said trailing outlet part (10), wherein said second ribs (14', 14") extend in a third direction forming a third angle (c) of inclination to said axis (x) in said leading part (9) and in a fourth direction forming a fourth angle (d) of inclination to said axis (x) in said trailing part (10), and that the third angle (c) is greater than the fourth angle (d).

3. A component according to claim 2, characterized in that the directions of the first ribs (13', 13") intersect with the directions of the second ribs (14', 14").

4. A component according to claim 3, characterized in that the first ribs (13', 13") are joined to the second ribs (14', 14") in said point of intersection.

5. A component according to claim 4, wherein the absolute values of said first and third angles are essentially equal at least in said point of intersection.

6. A component according to claim 4, wherein the absolute values of said second and fourth angles are essentially equal at least in said point of intersection.

7. A component according to claim 4, wherein the first ribs are provided on a suction side of the component and sloping upwardly from said axis and from the leading part of said channels, and that the second ribs are provided on a pressure side of the component and sloping downwardly to said axis and from the leading part of said channels.

8. A component according to claim 3, characterized in that the absolute values of said first and third angles (a, c) are essentially equal at least in said point of intersection.

9. A component according to claim 8, wherein the absolute values of said second and fourth angles are essentially equal at least in said point of intersection.

10. A component according to claim 8, wherein the first ribs are provided on a suction side of the component and sloping upwardly from said axis and from the leading part of said channels, and that the second ribs are provided on a pressure side of the component and sloping downwardly to said axis and from the leading part of said channels.

11. A component according to claim 3, characterized in that the absolute values of said second and fourth angles (b, d) are essentially equal at least in said point of intersection.

12. A component according to claim 3, wherein the first ribs are provided on a suction side of the component and sloping upwardly from said axis and from the leading part of said channels, and that the second ribs are provided on a pressure side of the component and sloping downwardly to said axis and from the leading part of said channels.

13. A component according to claim 2, characterized in that the first ribs (13', 13") are provided on a suction side of the component (1) and sloping upwardly from said axis (x) and from the leading part (9) of said channels, and that the second ribs (14', 14") are provided on a pressure side of the component (1) and sloping downwardly to said axis (x) and from the leading part (9) of said channels.

14. A component according to claim 1, characterized in that said ribs (13', 13", 14', 14") are divided into a leading set of ribs (13', 1') and a trailing set of ribs (13", 14") by means of a gap (15).

15. A component according to claim 8, characterized in that said projecting element (16, 18) is provided at the inlet zone (17) of at least one of the leading and trailing sets of ribs (13', 13", 14', 14").

16. A component according to claim 1, characterized in that a projecting element (16, 18) is provided in at least one of said channels and arranged to increase the turbulence of the cooling fluid.

17. A component according to claim 9, characterized in that said projecting element (16, 18) is shaped as a rib element projecting form one of said first and second walls (7, 8).

18. A component according to claim 9, characterized in that said rib element (18) extends in a direction parallel to an inlet edge line of the actual set of ribs (13', 13", 14', 14").

19. A component according to claim 1, characterized in that the first angle (a, c) of inclination is between 40 and 80°.

20. A component according to claim 1, characterized in that the second angle (b, d) of inclination is between 10 and 50°.

* * * * *